United States Patent [19]

Wilkins

[11] 4,201,524

[45] May 6, 1980

[54] SUBMERSIBLE PUMP SYSTEM USING A SUBMERSIBLE INTERNAL COMBUSTION ENGINE

[76] Inventor: Richard S. Wilkins, 547 E. Center St., Provo, Utah 84601

[21] Appl. No.: 939,285

[22] Filed: Sep. 5, 1978

[51] Int. Cl.[2] ..... F04B 17/00; F04B 35/00

[52] U.S. Cl. ..... 417/364; 123/1 R

[58] Field of Search ..... 417/364, 313, 312, 368, 417/360, 380, 34; 123/198 P, 1 R

[56] References Cited

U.S. PATENT DOCUMENTS

| | | | |
|---|---|---|---|
| 2,429,732 | 10/1947 | Roos | 123/1 R |
| 2,818,814 | 1/1958 | Woods | 417/364 X |
| 3,371,613 | 3/1968 | Dahlgren et al. | 417/368 |

*Primary Examiner*—Richard E. Gluck

*Attorney, Agent, or Firm*—Criddle & Western

[57] ABSTRACT

A submersible pump system is disclosed which uses a submersible internal combustion engine as the drive means for the pump. The system is ideally suited for use in installations employing conventional submersible pumps driven with electrical motors as an auxiliary or standby system which is designed to be employed during periods when the conventional pumps are inoperable, such as during an electrical power failure. In addition, the system is useful for pumping applications wherein electrical power is not available. The system of this invention comprises a water-tight submersible enclosure having an internal combustion engine mounted therein. A submersible, centrifugal pump is mounted on the exterior of the enclosure, with the drive shaft of the pump extending into the enclosure through a water-tight seal therein and being connected to the output drive of the engine. A shroud is positioned between the engine and the interior sides of the enclosure so as to substantially surround the sides of the engine, with the lowermost end of the shroud being spaced from the bottom of the enclosure, so that a flow channel is formed extending downwardly between the enclosure and the shroud, around the lower end of the shroud, and upwardly through the inside of the shroud around the engine. First and second conduits or air ducts are attached to the upper ends of the shroud and the enclosure, respectively, and then extend upwardly, opening into the atmosphere. Fan means driven by the engine circulates atmospheric air downwardly through the outer conduit, through the flow channel formed by the shroud, and back up to the atmosphere through the inside conduit. Means are provided on the engine for drawing combustion air from the air circulated through the system by the fan means, while exhaust from the engine is released to the upward flow of air in the inside conduit.

4 Claims, 1 Drawing Figure

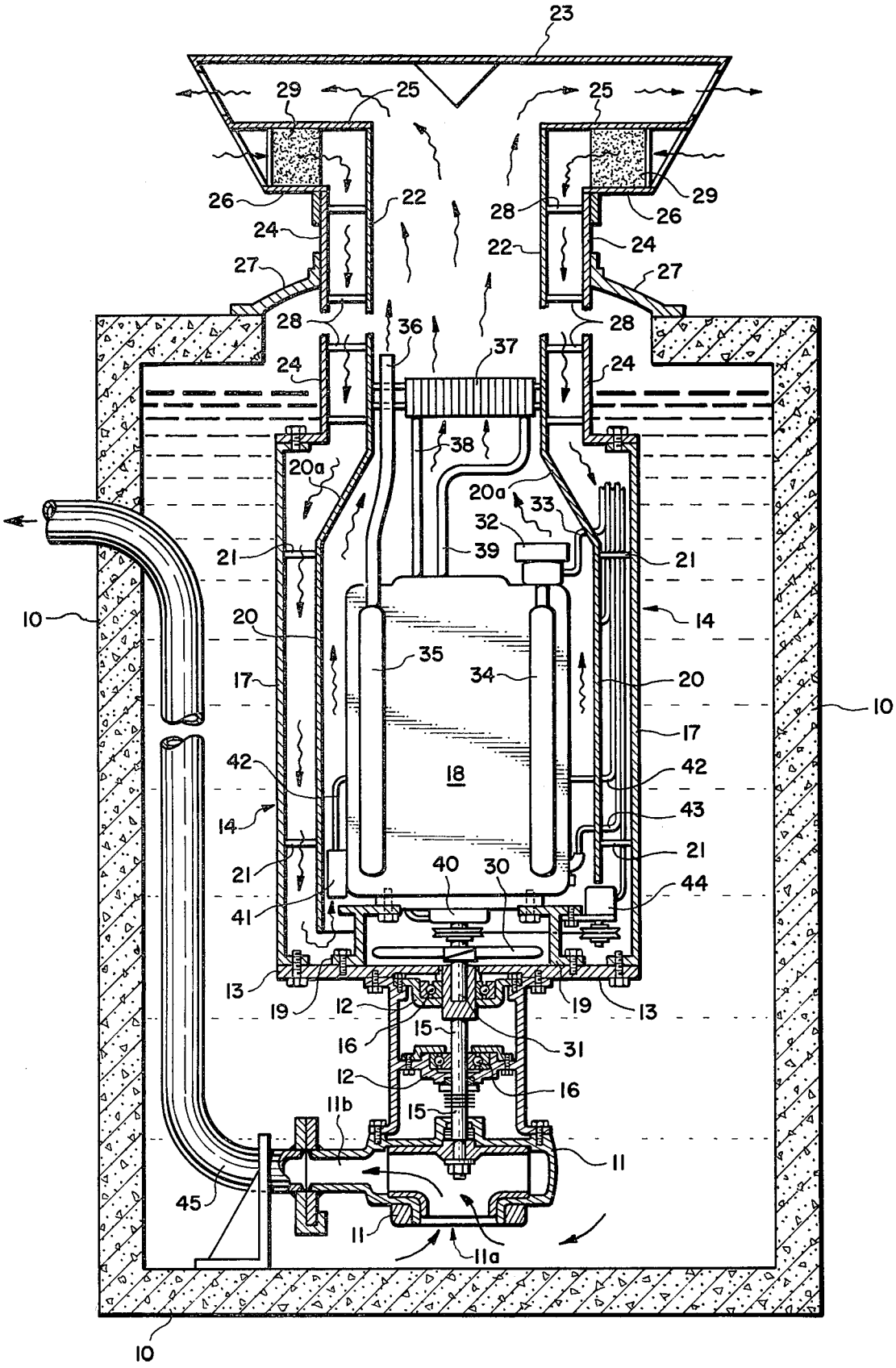
23
29
25
25
29
26
22
28
26
24
22
24
27
27
28
36
37
28
24
24
38
20a
20a
33
32
39
21
21
10
20
14
35
34
20
17
10
17
42
18
42
43
14
21
21
40
30
44
41
13
19
12
19
13
15
16
31
12
16
11b
15
11
45
11
11a
10

SUBMERSIBLE PUMP SYSTEM USING A SUBMERSIBLE INTERNAL COMBUSTION ENGINE

BACKGROUND OF THE INVENTION

1. Field

The invention pertains to submersible pump systems.

2. State of the Art

Submersible pumps driven by submersible electric motors close-coupled to the pumps are extensively used in numerous pumping applications. In these applications wherein temporary disruption of the pumps due to electrical power failure is to be avoided, it has been common practice to install standby electrical generation facilities near the pump system to provide a supplemental source of electrical power during any disruption in the primary source of electrical power. To the best of my knowledge, there have been no suggestions in the prior art of close coupling a submersible internal combustion engine to a submersible pump for use as a standby pump in case of electrical failure or for use wherein it is impractical to provide electrical power. Several systems have been proposed for providing motor vehicles of an amphibious nature wherein the vehicle can operate while submerged, for example, see U.S. Pat. Nos. 2,429,732; 3,680,521; and 3,892,079.

OBJECTIVES

The primary objective of the present invention is to provide a submersible pump system which utilizes a close-coupled, submersible, internal combustion engine as the drive means for the pump. A particular objective of the invention is to provide a submersible pump system using a submersible internal combustion engine wherein the pump system does not require excavation and provision for an operator-accessible, water-tight submerged room or vault in which the engine is installed, and wherein the pump system, including the engine, is easily removed as a unit from its submerged location for maintenance purposes.

SUMMARY OF THE INVENTION

In accordance with the present invention a relatively compact submersible pump system is provided utilizing a submersible internal combustion engine as the drive means for the pump. The compactness of the system is achieved while also providing a continuous flow of cool atmospheric air between the engine, including the exhaust system thereof, and the water-tight external enclosure for the system, so that the temperature of the enclosure is kept well below the flash point of any volatile material which may be contained in the sumps or collection vaults in which the submersible pump system is installed. Cooling of the enclosure is particularly desirable when the submersible pump system is used in sewage-handling or similar applications wherein methane or other volatile, flammable gases are present.

The submersible pump system of this invention comprises a water-tight submersible enclosure having an internal combustion engine mounted therein. The enclosure fits relatively compactly about the engine with just sufficient space between the engine and sidewalls of the enclosure to provide a flow channel between the enclosure and a shroud which is positioned between the engine and the enclosure so as to substantially surround the sides of the engine. The lowermost end of the shroud is spaced from the bottom of the enclosure so that the flow channel which is formed between the inside surface of the enclosure and the outside surface of the shroud continues on around the lower end of the shroud and extends upwardly through the inside of the shroud around the engine.

A submersible, centrifugal pump is mounted on the exterior of the enclosure with the drive shaft of the pump extending into the enclosure through a water-tight seal between the pump and the enclosure. The portion of the pump drive shaft which extends into the enclosure is connected by appropriate means to the output drive of the engine.

A first conduit or air duct is attached at one of its ends to the upper end of said shroud so that it is in flow communication with the inside of the shroud. The first conduit extends upwardly from the shroud, with its other end being open to the atmosphere. A second conduit or air duct is attached at one of its ends to the upper end of the enclosure, so that the second conduit is in flow communication with the first conduit through the flow channel which extends downwardly between the enclosure and the shroud, around the lower end of the shroud, and upwardly through the inside of the shroud. The second conduit extends upwardly from the enclosure, with its other end being open to atmospheric air.

Fan means in combination with and driven by the engine circulates atmospheric air downwardly through the second conduit, then through the flow channel so that the air flows downwardly through the space between the shroud and the walls of the enclosure, around the lower end of the shroud, and upwardly through the inside of the shroud around the engine. The air then flows upwardly through the first conduit and is exhausted back to the atmosphere.

The engine is provided with means for drawing combustion air from the air which is circulated through the system by the fan means. Exhaust means is provided on the engine for releasing exhaust gases from the engine to the flow of air in the first conduit.

Other features and advantages of the invention will become apparent from the following detailed description, taken together with the accompanying drawing.

THE DRAWING

The single FIGURE of the drawing is a vertical cross-section through a pump system of this invention as installed in the sump of a sewage-handling system. The engine and much of the auxiliary apparatus therefor are shown diagrammatically in block form for purpose of simplicity. Much of the auxiliary apparatus, especially such apparatus shown in block form, has been positioned arbitrarily around the engine in the drawing for purpose of clarity, and in no way is the drawing intended to imply actual or preferred positions of such apparatus.

DETAILED DESCRIPTION OF THE ILLUSTRATED EMBODIMENT

Referring to the drawing, a pump system in accordance with the present invention is shown installed in a sump or vault 10 of a sewage-handling application or other application in which a fluid collects in the sump or vault 10 to be pumped therefrom. A centrifugal pump 11 is positioned adjacent to the floor of the vault 10 and releasably secured to the flange of discharge pipe 45 by a slide flange which is adapted to make a wedge or slip fit with the flange of discharge pipe 45. A water-tight seal unit 12 is mounted between the centrifugal pump 11 and the base plate 13 of the enclosure member shown generally by the numeral 14. The drive shaft 15 of the pump 11 extends upward from the pump 11 through a double set of bearings and seals 16 contained in the seal unit 12 and extends into an opening in the base plate 13. Various other bearing and seal arrangements which are well known in the art can, of course, be used in place of the particular bearings and seals in the drawing.

The sidewalls 17 of enclosure 14 are firmly attached to the base plate 13 to make a water-tight connection therebetween. The sidewalls 17 extend upward from the periphery of the base plate 13 to enclose a space in which the internal combustion engine 18 is situated. The engine 18 is mounted to the base plate 13 by appropriate engine mounts 19.

A shroud 20 is positioned between the engine 18 and sidewalls 17 so as to surround the sides of the engine 18. The shroud 20 is held in place by hangers 21, and the lowermost end of the shroud 20 is spaced from the base plate 13, thereby forming a flow channel extending downwardly between the inside surface of the sidewalls 17 and the outside surface of the shroud 20, around the end of the shroud 20, and upwardly through the inside of the shroud 20 around the engine 18. The hangers 21 are elongate bars, round stock, etc., which are attached at mutually respective ends thereof, such as by welding, to the inside surface of the sidewalls 17. The other ends of the hangers are attached, such as by welding, to the shroud 20, holding the shroud 20 securely in place. The hangers 21 are equally spaced around the circumference of the shroud 20. Alternatively, the shroud 20 could be fastened directly to the engine 18.

A first air duct or conduit 22 is attached at one of its ends to the upper end of the shroud 20. As illustrated, the upper end of shroud 20 has a transition section 20a wherein the sidewalls slope inwardly so that the upper end of the shroud 20 has cross-sectional dimension which is smaller than the cross-sectional dimension of the main, body portion of the shroud 20. The first conduit 22 extends upwardly with its upper end being open to the atmosphere. A rain cover 23 is advantageously spaced directly over the open end of conduit 22 and extends outwardly somewhat beyond the periphery of the conduit 22, thereby preventing rain or other objects from falling into the conduit 22.

A second air duct or conduit 24 is attached at one of its ends to the upper end of the enclosure 14 and extends upwardly surrounding conduit 22 in substantially coaxial arrangement. The upper end of the second conduit is also open to atmospheric air. As illustrated, the conduit 24 is slightly shorter than conduit 22 so that the upper ends thereof are spaced from each other, with the end of the first conduit 22 being higher than the end of conduit 24. A flange 25 extends outwardly from the top edge of conduit 22 beyond the periphery of the second conduit 24. A second flange 26 extends outwardly from the top edge of conduit 24, so as to form in combination with flange 25 an "L"-shaped, annular opening through which the conduit 24 opens to the atmosphere. A seal 27 extends outwardly from the outer conduit 24 to the top of the sump or vault 10. Spacer elements 28 are positioned between the outer side of conduit 22 and the inner side of conduit 24 at various positions along their lengths thereby providing stability to the coaxial arrangement of the conduits.

The internal combustion engine 18 is provided with a fan 30 which is driven by the output drive shaft 31 of the engine 18. The output drive shaft 31 is also connected to the drive shaft 15 of the centrifugal pump 11.

The fan 30 is adapted to draw atmospheric air downwardly through the flow passageway between the inner side of conduit 24 and the outer side of conduit 22 and then downwardly through the space between the shroud 20 and the walls 17 of the enclosure 14. The flow of air is drawn around the end of the shroud 20, and the fan 30 then blows the air upwardly through the inside of the shroud 20 around the engine 18. The air then flows through the transition section 20a of shroud 20 and is blown upwardly through the conduit 22 and is exhausted through the opening between the cover 23 and flange 25 to the atmoshere. An annular air filter 29 is preferably positioned in the annular opening formed between flanges 25 and 26 which filters the atmospheric air which is drawn into the air circulation system by the fan 30.

The engine 18 is provided with means for drawing combustion air from the air which is circulated through the system by the fan 30 and for delivering a mixture of the combustion air and fuel to the engine. For a conventional gasoline engine, a carburetor 32 is provided which draws combustion air from the air flowing downwardly through the second conduit 24 and around shroud 20 or the air flowing upwardly through the inside of the shroud 20 and around the engine 18, depending on where the carburetor is mounted. Preferably, the carburetor is mounted outside the shroud 20 so as to draw combustion air from the cool air flowing downwardly through conduit 24 and around the outside of shroud 20. Fuel is fed to the carburetor 32 through fuel line 33 which extends to a ground level fuel tank (not shown in drawing) through the passageway formed by the outside wall of the first conduit 22 and the inside wall of the second conduit 24. Due to the elevation of the fuel tank relative to the engine, a fuel pump is not ordinarily required. A fuel-air mixture is fed from the carburetor 32 to the cylinders of the engine 18 through an intake manifold 34 on the engine 18.

Exhaust gases from the engine 18 are collected by an exhaust manifold 35 and flow through an exhaust pipe 36 which extends upwardly beyond the transition section 20a of the shroud 20 into the conduit 22, wherein the exhaust gases are released to mix with the upwardly moving stream of air therein.

The engine 18 can be either air cooled or be provided with a conventional coolant recirculation system. As illustrated, the engine 18 is cooled using a coolant recirculation system, wherein the radiator 37 used in cooling the coolant is mounted in the first conduit 22 just above the transition section 20a of shroud 20. The exhaust pipe 36 extends just beyond radiator 37 so that the hot exhaust gases contained therein will not adversely affect the cooling of the recirculating coolant in the radiator 37. The coolant (water and possibly an antifreeze agent) is pumped to the radiator 37 through radiator hose 38 and returned to the engine from the radiator by return hose 39. A conventional water pump 40 which is driven by the output drive shaft 31 of the engine provides the pumping means for recirculating the coolant between the engine 18 and the radiator 37.

Maintenance of the pump and engine is advantageously facilitated by the compact nature of the system, whereby the entire pump system is easily pulled from the sump so that maintenance work can be accomplished on the system at ground level. Routine oil changes, etc., can also be performed by pulling the system from the sump. Alternatively, means can be provided for routine addition and changing of oil in the engine 18. As illustrated, such means may include an oil pump 41, which is separate and apart from the conventional oil pump used to circulate oil within the engine 18, is positioned adjacent to the oil drain plug of the engine 18. The oil drain plug is replaced by a solenoid operated valve which can be operated from above ground. An oil pipe 42 extends from the pump 41 upwardly through the passageway between the first and second conduits 22 and 24 to ground level. When the engine oil is to be changed, the solenoid valve is opened allowing oil to flow from the engine 18 to the pump 41. The pump 41 is turned on and the crankcase oil is pumped out of the engine 18. New oil is fed to the engine through an oil-fill pipe 43 which extends downwardly from ground level to the oil-fill pipe on the engine 18.

The electrical system of the engine 18 is the same as used with conventional internal combustion engines. As shown in the drawing, an alternator 44 is driven by a belt and pulley from the drive shaft 31 of the engine 18. Alternatively, the alternator could be driven directly from the drive shaft 31 or through a set of gears. The battery (not shown) used for storing the electrical energy from the alternator 44 is located above ground with the appropriate electrical connections with the alternator. An ignition switch (not shown) is also provided above ground for starting and stopping the engine 18. The ignition wires as well as other wires transmitting information concerning oil pressure, oil level, engine temperature, etc., are easily run through the passageway between the first and second conduits 22 and 24 and then through the shroud 20 into the engine compartment.

In operation, the engine 18 turns the impeller of pump 11 and liquids are drawn into the pump 11 through its intake 11*a*. The liquids are then pumped through the outlet 11*b* of the pump to appropriate pipe 45 which directs the fluid upwardly to the desired level. The downward flow of cooling air through the passageway between the first and second conduits 22 and 24 and around the outside of the shroud 20, completely isolates the heat produced by the engine 18 from the enclosure 17 or the second conduit 24. Thus, the only parts of the pumping system of this invention which come in contact with the liquids and environment within the sump or vault 10 are maintained cool so that their temperatures are always maintained well below the flash point for gases, liquids, and solids that might be contained in the sump or vault 10.

The pump system is relatively compact and is, thus, ideally suited as a standby system to be installed alongside conventional electrically driven submersible pumps and used during periods of electrical failure. The engine 18 of the submersible pump system of this invention need have only one-half the horsepower requirement of an equivalent standby engine generator located above ground and used to generate electricity for the conventional electrically driven pumps during periods of electrical power failure. In addition, there is no need to provide a building above the sump or vault 10 when using the submersible pump system of this invention, whereas such a building is normally used to house a standby engine generator system.

Although the invention has been described in detail with respect to a particularly preferred embodiment, presently contemplated as the best mode of carrying out the invention, it will be understood by those of ordinary skill in the art that variations and modifications may be effected without departing from the subject matter coming within the scope of the following claims, which subject matter is regarded as the invention. For example, the invention has been described in connection with a centrifugal pump, but, it is to be understood that other type pumping units, such as lobe pumps, vein pumps, etc., could also be used in place of the centrifugal pump.

I claim:

1. A submersible pump system having a submersible internal combustion engine for driving the pump, said system comprising a water-tight, submersible enclosure; an internal combustion engine mounted within said enclosure; a shroud positioned between said engine and the sides of said enclosure so as to substantially surround the sides of said engine, with the lowermost end of said shroud being spaced from the bottom of said enclosure so that a flow channel is formed extending downwardly between the inside surface of said enclosure and the outside surface of said shroud, around the lower end of said shroud, and upwardly through the inside of said shroud around said engine; a submersible pump mounted on the exterior of said enclosure, said pump having a drive shaft extending into said enclosure through a water-tight seal between said pump and said enclosure; means for connecting the end of said drive shaft which extends into said enclosure to the output drive of said engine; a first conduit attached at one of its ends to the upper end of said shroud so that said first conduit is in flow communication with the inside of said shroud, said first conduit extending upwardly with its other end being open to the atmosphere; a second conduit attached at one of its ends to the upper end of said enclosure so that said second conduit is in flow communication with the first conduit through said flow channel, said second conduit extending upwardly with its other end being open to atmospheric air; fan means driven by said engine which circulates atmospheric air downwardly through said second conduit, then through said flow channel so that the air flows downwardly through the space between the shroud and the walls of said enclosure, around the lower end of the shroud, and upwardly through the inside of the shroud around said engine, and then back up through said first conduit; means on said engine for drawing combustion air from the air which is circulated through the system by said fan means; and exhaust means on said engine which releases exhaust gases from said engine to the flow of air in said first conduit.

2. A submersible pump system in accordance with claim 1, wherein the first conduit extends upwardly within said second conduit thereby forming an elongate, annular-like, flow passage between the first and second conduits through which the atmospheric air is induced downwardly by the fan to the flow channel around the shroud and engine.

3. A submersible pump system in accordance with claim 2, wherein the engine is cooled with a recirculating liquid coolant and provided with a radiator for cooling the coolant in the engine cooling system, said radiator being mounted in said first conduit adjacent to the end thereof which is attached to said shroud, and said exhaust means is adapted to release the exhaust gases from said engine to the flow of air in said first conduit at a point downstream from said radiator.

4. A submersible pump system in accordance with claim 1, wherein the submersible pump is a centrifugal pump.

* * * * *